United States Patent [19]

Miskin et al.

[11] Patent Number: 4,926,553

[45] Date of Patent: May 22, 1990

[54] RAZOR

[75] Inventors: Michael Miskin, 4927 N. Lester, Chicago, Ill. 60630; William Bamford, 778 Leicester Rd., Elk Grove Village, Ill. 60007; Micheal D. Lake, Chicago, Ill.

[73] Assignees: Michael Miskin, Chicago; William Bamford, Elk Grove Village, both of Ill.

[21] Appl. No.: 283,217

[22] Filed: Dec. 12, 1988

Related U.S. Application Data

[63] Continuation-in-part of Ser. No. 74,775, Jul. 17, 1987, abandoned.

[51] Int. Cl.[5] ..... B26B 21/28

[52] U.S. Cl. ..... 30/49; 30/87; 30/89

[58] Field of Search ..... 30/32, 76, 81, 84, 87, 30/49, 57, 87, 89

[56] References Cited

U.S. PATENT DOCUMENTS

| | | | |
|---|---|---|---|
| 827,718 | 8/1906 | Vom Eigen | 30/87 X |
| 2,510,951 | 6/1950 | Bleeker et al. | 30/87 X |
| 4,590,674 | 5/1986 | Harper | 30/49 |

*Primary Examiner*—Hien H. Phan

*Attorney, Agent, or Firm*—Wallenstein, Wagner & Hattis, Ltd.

[57] ABSTRACT

A razor for trimming and shaping of beards, mustaches, sideburns and the like is disclosed. The razor comprises an elongated handle, a tapered offset neck on one end of the handle and a razor head pivotally attached to the neck by a ball and socket joint interposed therebetween. A pivot lock locks the razor head in a desired attitude with respect to the handle and is controllable from the neck of the razor. The razor head carries a blade having opposed arcuate cutting edges, marginal edges of which extend from opposed arcuate surfaces of the razor head. The ball of the ball and socket is a center-cut ball presenting a path therethrough. The pivot lock is slidable into the center path of the ball to expand the ball, thus, locking the razor head in a fixed attitude to the handle of the razor.

12 Claims, 2 Drawing Sheets

RAZOR

DESCRIPTION

This application is a CONTINUATION-IN-PART of copending U.S. patent application Ser. No. 074,775 filed on July 17, 1987 entitled "Trimline", now abandoned.

TECHNICAL FIELD

The present invention relates to razors for trimming and shaping beards, mustaches, sideburns and the like and more particularly to an arcuate blade type razor with an offset adjustable razor head.

BACKGROUND OF THE INVENTION

The trimming and shaping of beards, mustaches and side burns is essential for proper grooming and style for the majority of men who wear them.

Conventional razors generally include a rectangular razor head mounted on an elongated handle in a fixed transverse relation to the handle. Conventionally, a straight cutting edge extends from one side or from two opposed sides of the razor head.

The purpose of conventional razors is to remove all or most of the hair from the face. Therefore, the razor head and cutting edges are broad relative to normal facial contours so that the number of shaving strokes required to shave a facial area is reduced. Although conventional razors are well suited to the purpose for which they are intended, they are inadequate for trimming and shaping purposes for several reasons.

The relatively broad razor head cannot be used to trim in small areas presented by facial obstructions such as the area between a mustache and a nose. The broad straight razor head and cutting edge make conventional razors inadequate for trimming or shaping arcuate outlines of a beard or for trimming in contoured areas isolated by facial hair, such as between the lower lip and chin.

Furthermore, a clear view of the area to be trimmed is essential for proper trimming and shaping. Conventional razors frequently obstruct a user's view in a number of ways.

For example, whereas the razor head of a conventional razor is broad, only a portion of the razor may be required for trimming in a particular localized area. Thus, the remainder of the razor head blocks the user's view of the area to be trimmed. In addition, because the handle and the razor head are conventionally in fixed relation, it may be difficult for the user to position his hand to achieve the desired position of the cutting edge. Furthermore the hand, thus situated, may obstruct the necessary view.

In recent years, attempts have been made to overcome the deficiencies of conventional razors. For example, razors are disclosed in U.S. Pat. Nos. 4,285,124 and 4,335,509. However, these razors have straight cutting edges and a razor head which remains fixed relative to the handle of the razor.

SUMMARY OF THE INVENTION

It is the object of the present invention to provide a razor particularly suited to the trimming and shaping of beards, mustaches, sideburns and the like.

According to the invention, the razor includes an elongated handle, a razor head and a neck joining the razor head to one end of the handle.

The neck is axially offset and tapered from the handle to the razor head for improved visibility of the area to be trimmed.

The razor head is pivotally mounted on the neck and can be pivoted about three orthogonal axes thereof; so that, the angular position of the razor head with respect to the handle (attitude) may be adjusted by the user as desired.

A pivot lock is provided for locking the razor head in a desired attitude. The pivot lock includes a ball joint which has a center-cut ball, a slidable lock member, a lock control member and position retention lugs.

The ball is located on the end of the razor neck and is received in a socket of the razor head. An elongated hollow in the neck houses the slidable lock member. The lock control member is attached transversely to the slidable lock member and extends outside the elongated hollow for access by the user. The slidable lock member is extendable into a center path of the ball by pushing the lock control member in a forward direction, thus, expanding the ball in the socket and locking the razor head in the desired position.

The lock control member is located on the neck so that so that the razor head can be locked, conveniently, by the thumb or a finger of the same hand as holds the handle.

The position retention lugs maintain the slidable lock member in a locked position. The retention lugs include a ratchet lug attached to the slidable lock member and stationary lugs formed on the inside of the elongated hollow. The lugs cooperate to releasably secure the slidable member in a forward position thus maintaining a locked position. The lugs can be disengaged for retraction of the slidable member by depressing the lock control member and sliding the lock control member in a reverse direction.

The razor head includes an arcuate surface having an arcuate cutting edge extending therefrom for narrow and adjustable contact with the skin of a user. The arcuate cutting edge also provides for trimming an outline of facial hair while tapering the growth proximate thereto when the cutting edge is pulled perpendicularly along an outline of the desired area.

Other advantages and aspects of the invention will become apparent upon making reference to the specification, claims, and drawings to follow.

DETAILED DESCRIPTION OF THE INVENTION

Figure 1:
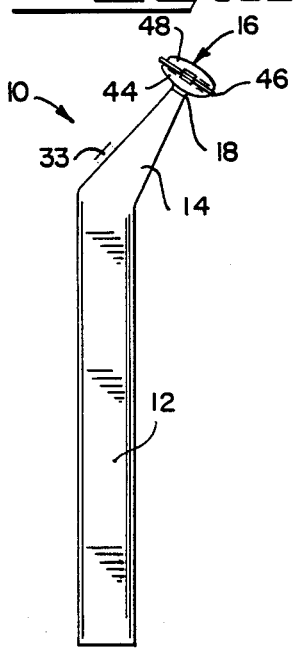
FIG. 1 is a side elevational view of the razor of the present invention.

While my invention is susceptible of embodiment in many different forms, there is shown in the drawings, and will herein be described in detail, preferred embodiments of my invention. The present disclosure is to be considered as an exemplification of the principles of my invention and is not intended to limit the broad aspect of my invention to the embodiments illustrated.

Figure 2:
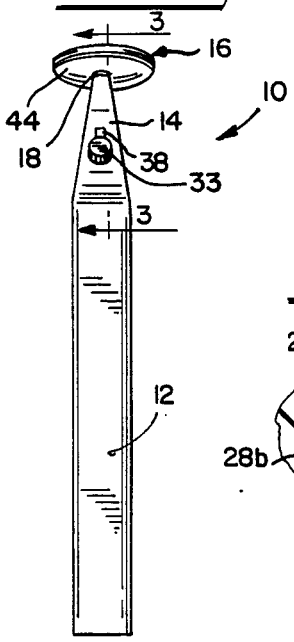
FIG. 2 is rear elevational view of the razor.

Referring to the drawings, FIGS. 1 and 2 disclose a preferred embodiment of the razor of the present invention generally referenced by 10.

Razor 10 generally comprises an elongated handle 12, a razor head 16 and a neck 14 joining the razor head 16 with one end of the handle 12. The razor head 16 is generally transversely oriented with the neck 14. Neck 14 is axially offset from handle 12 and is tapered from handle 12 to razor head 16, thus defining a narrow end 15 of neck 14.

A pivot joint 18 is interposed between the razor head 16 and neck 14 to pivotally join the razor head 16 to the neck 14. A lock control member 32, with an annular widened portion 33 is exposed on neck 14 so that the user can control a pivot lock 20 located within neck 14 to lock the razor head into a desired position relative to the handle 12, as will be discussed in more detail below.

As best disclosed in FIGS. 6, 7 and 8, razor head 16 generally includes a base 44, a blade 46 and a cap 48 securing blade 46 to the base 44, as further detailed below.

Figure 5:
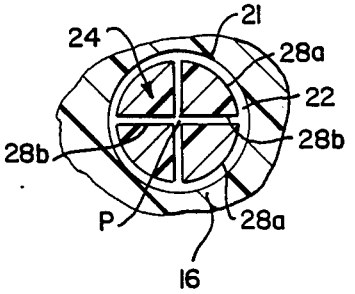
FIG. 5 is a cross sectional view of a portion of the razor taken along line 5—5 of FIG. 3.
Figure 3:
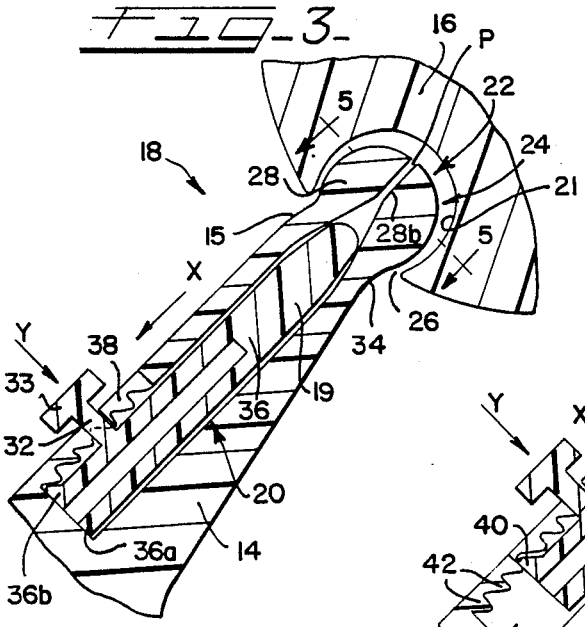
FIG. 3 is a cross sectional view of a portion of the razor taken along line 3—3 of FIG. 2 disclosing the razor head in an unlocked position with the slidable lock member retracted.
Figure 4:
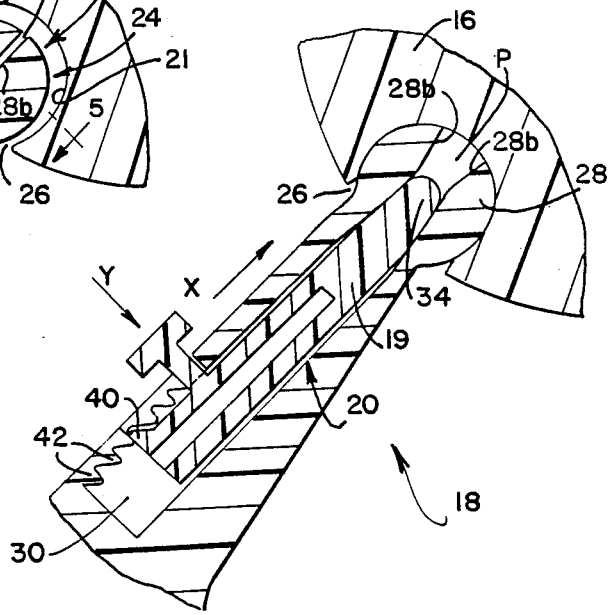
FIG. 4 is the same view as FIG. 3, illustrating the razor head in a locked position with the slidable lock member extended into the expandable ball.

As disclosed in FIGS. 3, 4 and 5, narrow end 15 of neck 14 terminates in the form of an expandable ball 24. Pivot joint 18 includes expandable ball 24 received in a socket 22. Socket 22 is formed in one surface of base 44 of razor head 16 and has an opening 26. Socket 22 has an arcuate inner surface 2 and is dimensioned for pivotal cooperation with expandable ball 24.

Expandable ball 24 is divided into four separate lobes 28, each lobe having an arcuate outer surface 28*a* and an inner surface 28*b*. Lobes 28 are circumferentially spaced from each other with inner surfaces 28*b* defining a path P between lobes 28. Neck 14 has an elongated hollow 30 which extends along the inside of neck 14 and opens into path P. Each of the lobes 28 is resiliently attached to neck 14 so that the lobes can be spread apart by the pivot lock 20 which resides in hollow 30.

As will be discussed in more detail below, locking of razor head 16 is achieved by spreading lobes 28 to expand ball 24 within socket 22. Ball 24 is expanded until the arcuate surfaces 28*a* of each lobe 28 frictionally engages the arcuate inner surface 21 of socket 22.

FIG. 3 discloses expandable ball 24 in a closed position wherein rotation of razor head 16 is permitted.

FIG. 4 discloses expandable ball 24 in an expanded condition wherein razor head 16 is locked.

Thus, the pivot joint 18 provides for razor head 16 to have rotational freedom about three orthogonal axes relative to neck 14 to obtain a desired attitude of razor head 16 to handle 12. Once a desired attitude of razor head 16 is achieved, razor head 16 can be securely locked in position by pivot lock 20.

Pivot lock 20 includes a slidable lock member 19 with opposed first and second ends 34 and 36, first and second legs 36*a* and 36*b* and a lock control member 32. Slidable lock member 19 and legs 36*a* and 36*b* are located within hollow 30 and are dimensioned to be slidable therein.

First end 34 of lock member 19 is tapered and terminates in an arcuate form so that, as it is extended into path P, it smoothly and gradually engages inner surfaces 28*b* of the lobes 28. Each of the inner surfaces 28*b* has an upper portion which is parallel to the inner surface 28*b* of each adjacent lobe 28. A lower portion of each lobe 28 inclines to hollow 30. In this configuration, inner surfaces 28*b* provide a camming action between end 34 of the slidable lock member and lobes 28 to facilitate spreading of ball 24.

Slidable lock member 19 has a first leg 36*a* and a second leg 36*b* extending generally in the plane thereof from end 36. Each leg 36*a* and 36*b* have opposed ends. Each leg 36*a* and 36*b* is attached to slidable lock member 19 at end 36 by one of its ends while the other end defines a free end thereof.

Lock control member 32 is attached to leg 36*b* and extends perpendicularly therefrom through an elongated opening 38 located in a side of hollow 30. Lock control member 32 terminates in a widened portion 33 which is adapted for engagement with the finger of a user. Legs 36*a* and 36*b* are spaced from each other and are made from a resilient type material such as plastic so that leg 36*b* can be resiliently deflected by depressing lock control member 32.

Leg 36*b* includes a ratchet lug 40 on its free end. Ratchet lug 40 is in the form of a right triangle and has a flat side extending perpendicular from leg 36*b* and an opposed side which is inclined with respect to leg 36*b*. A plurality of stationary lugs 42 are located in series on an inner wall of hollow 30. Stationary lugs 42 have reciprocal geometries relative to ratchet lug 40 and are adapted to cooperatively engage therewith for stepwise position securement of pivot lock 20.

Thus, in order to lock razor head 16 in a fixed attitude, a user need only push lock control member 32 in a forward direction (indicated by arrow X in FIG. 4) until the razor head is secure. As pivot lock 20 is advanced, the inclined surfaces of ratchet lug 40 and stationary lugs 42 permit advancement over each other. Second leg 36*b* resiliently urges ratchet lug 40 against stationary lugs 42 so that, as each stationary lug 42 is passed, the flat surface of ratchet lug 40 is brought into engagement with the flat surface of the previous stationary lug 42 so that the forward position of pivot lock 20 is retained.

To reposition razor head 16, lock control member 32 need only be simultaneously depressed, in the direction of arrow Y of FIGS. 3 and 4, and pushed in a reverse direction (indicated by arrow X of FIG. 3) thus disengaging ratchet lug 40 from stationary lugs 42 and retracting end 34 from path P so that ball 24 will close.

Razor head 16 can be removed for disposal and replaced. Accordingly, expandable ball 24 and opening 26 of razor head 16 are dimensioned so that, as the ball is forced in or out of socket 22, the lobes 28 are forced together so that the parallel portion of inner surfaces 28*b* are touching each other. In this position, a diameter of ball 24 is reduced to a dimension smaller than a diameter of ball 24 in the closed position. Thus, razor head 16 can be removed and replaced by snapping ball 24 into and out of socket 22.

Razor head 16 having arcuate cutting edges is illustrated in FIGS. 5, 6, 7 and 8.

Figure 8A:
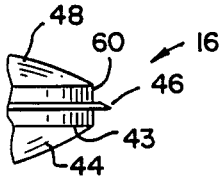
FIG. 8*a* is a side elevational view of a portion of the razor head of the razor taken along line 8—8 of FIG. 6.
Figure 8B:
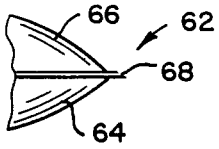
FIG. 8*b* is the same view as in FIG. 8*a*, disclosing an alternate embodiment of the razor head of the razor; and, FIG. 9 is a schematic view of an arcuate cutting edge engaging a portion of a face with facial hair.
Figure 8:
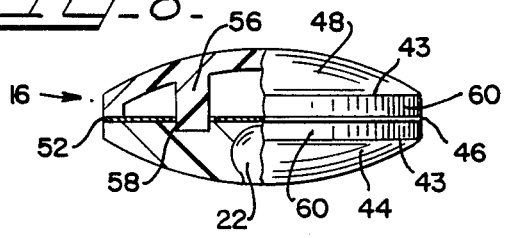
FIG. 8 is a front elevational view of the razor head of the razor with a partial cross section view taken along line 8—8 of FIG. 6.

As best disclosed in FIG. 8, razor head 16 includes a base 44, a blade 46 seated on the base 44 and a cap 48 over blade 46. The cap 48 secures blade 46 to base 44.

Figure 7:
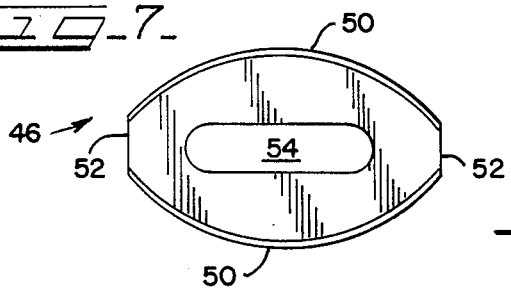
FIG. 7 is a plan view of the razor blade of the razor.

As best disclosed in FIG. 7, blade 46 is a flat member having opposed arcuate cutting edges 50, opposed straight edges 52 and an elongated opening 54 through a medial portion of the blade. Opening 54 has opposed parallel straight sides and arcuate end sides. Blade 46 is made from conventional razor blade materials having conventional thickness. Edges 50 are sharpened along their entire extent to present a cutting surface.

Figure 6:
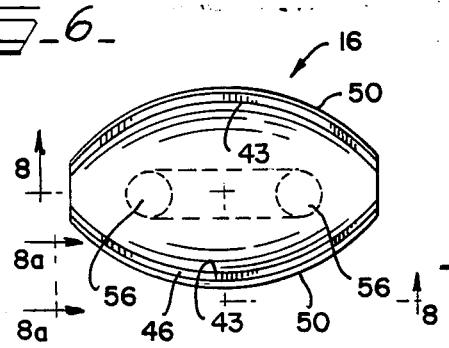
FIG. 6 is a top elevational view of the razor head of the razor.

As disclosed in FIGS. 1, 6 and 8, cap 48 and base 44 are provided with arcuate sides 43 so that an even margin of blade 46, along both blade edges 50, extends from opposed sides of razor head 16. Cap 48 and base 44 are coterminous with blade ends 52.

In one preferred embodiment, as disclosed in FIGS. 8 and 8*a*, the arcuate sides of cap 48 and base 44 define a marginal surface 60 which is perpendicular to the exposed margin of blade 46.

FIG. 8*b* discloses an alternate embodiment of razor 10 wherein a razor head 62 is provided including a base 64 and a cap 66. Razor head 62 is configured the same as razor head 16, disclosed above, with the exception that the arcuate edges of cap 66 and base 64 taper directly away from the exposed margin of blade 46. In this configuration, the razor head 62 facilitates increased accessibility into obstructed areas such as that area between the user's nose and mustache. This configuration also provides improved visibility of the area to be trimmed or shaved.

FIGS. 6 and 8, disclose that blade 46 is aligned and secured into position by locating pins 56 which are attached to cap 48 and extend through opening 54 into blind openings 58 in base 44. Locating pins 56 are spaced from each other and are dimensioned to engage the arcuate sides of opening 54 to prevent horizontal movement of the blade 46. Locating pins 56 are dimensioned to present an interference fit with openings 58 for securement therein.

Providing two cutting edges on blade 46 allows a user to trim with either edge 50 by merely rotating razor head 16 into the appropriate position when, for instance, one edge 50 becomes dull.

Figure 9:
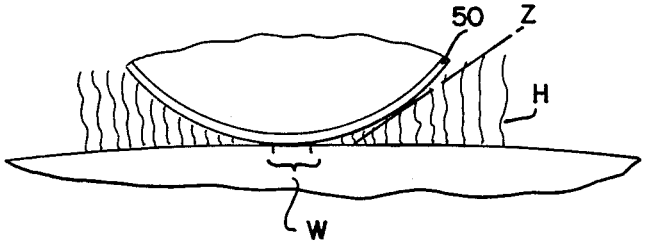

As disclosed in FIG. 9, the provision of an arcuate cutting edge 50 achieves a number of desired results. For example, as illustrated by the dashed line Z of FIG. 9, the arcuate cutting edge 50 can provide a tapered trim along an outline area of facial hair growth, referenced by H of FIG. 9.

Furthermore, the arcuate cutting edge 50 can be used for shaving a narrow facial portion because the arcuate cutting edge 50 engages relatively flat portions of skin only along a tangent of the cutting edge 50, as indicated by W in FIG. 9.

While my invention has been described with reference to preferred embodiments, it will be understood by those skilled in the art that various changes may be made and equivalents may be substituted for elements thereof without departing from the broader aspects of my invention. Also, it is intended that broad claims not specifying details of a particular embodiment disclosed herein as the best mode contemplated for carrying out my invention should not be limited to such details.

We claim:

1. A razor for removing, trimming and shaping facial hair comprising:

an elongated handle having a longitudinal axis and opposed ends;

a razor head including a cutting edge extending from a surface thereof;

said cutting edge being adapted to engage and sever hair;

a neck joining said razor head to one end of said handle;

said neck having opposed ends with one said end attached to said handle and an opposed end terminating in the form of an expandable ball;

a socket located in a surface of said razor head;

said expandable ball being received in said socket for rotation therein so that an angular position of said razor head relative to said neck can be adjusted about three orthogonal axes of said neck to obtain a desired attitude of said razor head to said handle; and, locking means operably connected to said expandable ball for locking said razor head after said razor head is adjusted to a desired attitude;

said ball being expandable within said socket by said locking means so that said razor head can be locked into a fixed position by expansion of said ball within said socket to a point where said ball can no longer freely rotate within said socket.

2. The razor of claim 1 wherein said neck includes a longitudinal axis;

said longitudinal axis of said neck being offset with respect to said longitudinal axis of said handle; and, said neck being tapered from said handle to said razor head.

3. The razor of claim 2 wherein said cutting edge is arcuate.

4. The razor of claim 1 wherein said cutting edge is arcuate.

5. The razor of claim 4 wherein said surface of said razor head is arcuate and said arcuate cutting edge extends therefrom.

6. The razor of claim 1 wherein said razor head has two opposed surfaces and an arcuate cutting edge extending from each said surface.

7. A razor for removing, trimming and shaping facial hair comprising:

an elongated handle having a longitudinal axis and opposed ends;

a razor head including a cutting edge extending from a surface thereof;

said cutting edge being adapted to engage and sever hair;

a neck joining said razor head to one end of said handle, said neck having a longitudinal axis and opposed first and second ends;

said first end of said neck being attached to said handle and said second end of said neck terminating in an expandable ball;

a socket being located in a surface of said razor head;

said longitudinal axis of said neck being offset with respect to said longitudinal axis of said handle;

said socket having an arcuate inner surface and having an opening to allow the passage of at least a portion of said expandable ball therethrough;

said socket being dimensioned to receive said expandable ball for pivotal joining of said razor head to said neck and thereby permitting said razor head to be adjusted about three orthogonal axes of said neck so that an attitude of said razor head relative to said handle can be adjusted as desired by a user;

an elongated hollow located within said neck;

locking means located within said elongated hollow of said neck for expanding said expandable ball to lock said razor head in a fixed position;

said expandable ball being divided into a plurality of separate lobes each having arcuate outer surfaces, inner surfaces and opposed ends;

said lobes being circumferentially spaced from each other with said inner surfaces defining a path therebetween;

each said lobe being resiliently attached to said neck;

said path extending into said elongated hollow;

said locking means including an elongated slidable lock member with opposed first and second ends and a lock control member attached thereto;

said lock control member extending outside said neck through an elongated opening in a side of said elongated hollow so that a user may control said slidable lock member by said lock control member from a position on said offset neck;

said slidable lock member being dimensioned to be slidable within said elongated hollow and said lock control member being slidable in said elongated opening;

whereby, said first end of said slidable lock member is extendable into said path to expand said expandable ball and said slidable lock member is retractable to allow said expandable ball to close; and, position retention means on said slidable lock member for releasably retaining said slidable lock member in a position once placed there by a user;

whereby, said expandable ball is rotatable in said socket when said expandable ball is in a closed position, and the user need only push said lock control member to extend said first end of said slidable lock member into said path between said lobes thereby expanding said expandable ball so that said arcuate outer surface of each said lobe is frictionally engaged against said inner surface of said socket thus locking said razor head in a desired position with said position retention means maintaining said position of said slidable lock member.

8. The razor of claim 7 wherein said opening in said socket having a diameter dimensioned to pass said expandable ball therethrough when said inner surfaces of said lobes are touching each other, so that said razor head may be removed and replaced by snapping said expandable ball into and out of said socket.

9. The razor of claim 7 wherein said offset neck is tapered from said handle to said razor head.

10. The razor of claim 7 wherein said surface of said razor head is arcuate and said arcuate cutting edge extends therefrom.

11. The razor of claim 7 wherein said cutting edge is arcuate.

12. The razor of claim 7 wherein said position retention means includes a resilient leg attached to said second end of said slidable lock member;

said lock control member being attached to said resilient leg;

said resilient leg having opposed first and second ends;

said first end of said resilient leg being attached to said second end of said slidable lock member;

said second end of said resilient leg being free so that said resilient leg can be deflected;

a ratchet lug attached to said second end of said resilient leg;

a plurality of stationary lugs attached along an inner surface of said hollow portion of said offset neck;

said stationary lugs having reciprocal geometry to said ratchet lug and said resilient member urging said ratchet lug into engagement with said stationary lugs;

whereby, movement of said lock member in a forward direction to expand said expandable ball is permitted by said lugs in a step-wise manner but movement in a reverse direction is obstructed and said position of said lock member is retained; and, whereby, when said lock control member is depressed, toward said neck, said resilient leg is deflected and said ratchet lug is disengaged from said stationary lugs thus permitting said lock member to be moved in a reverse direction.

* * * * *

UNITED STATES PATENT AND TRADEMARK OFFICE

CERTIFICATE OF CORRECTION

PATENT NO. : 4,926,553

DATED : May 22, 1990

INVENTOR(S) : Michael Miskin, William Bamford and Micheal D. Lake

It is certified that error appears in the above-identified patent and that said Letters Patent is hereby corrected as shown below:

Column 6, line 38, "2" should read -- 1 --

Column 6, line 40, "1" should read -- 2 --

Column 6, line 45, "1" should read -- 3 --

Column 7, line 5, after "razor head" delete "relative"

Column 8, line 11, "10." should read -- 11. --, and "7" should read -- 9 --

Column 8, line 14, "11." should read -- 10. --

Signed and Sealed this

Tenth Day of March, 1992

*Attest:*

*Attesting Officer*

HARRY F. MANBECK, JR.

*Commissioner of Patents and Trademarks*